US006725902B2

(12) United States Patent
Blum et al.

(10) Patent No.: US 6,725,902 B2
(45) Date of Patent: Apr. 27, 2004

(54) PROCESS AND APPARATUS FOR PRODUCING PRECISION CASTINGS

(75) Inventors: Matthias Blum, Büdingen (DE); Georg Jarczyk, Grosskrotzenburg (DE); Hans-Günther Fellmann, Blankenbach (DE); Peter Busse, Aachen (DE)

(73) Assignee: Ald Vacuum Technologies AG, Hanau (DE)

( * ) Notice: Subject to any disclaimer, the term of this patent is extended or adjusted under 35 U.S.C. 154(b) by 0 days.

(21) Appl. No.: 10/126,381

(22) Filed: Apr. 19, 2002

(65) Prior Publication Data

US 2002/0179275 A1 Dec. 5, 2002

(30) Foreign Application Priority Data

Apr. 26, 2001 (DE) ..... 101 20 493

(51) Int. Cl.[7] ..... B22D 13/00

(52) U.S. Cl. ..... 164/114; 164/289; 164/292; 164/298

(58) Field of Search ..... 164/114–118, 286–302

(56) References Cited

U.S. PATENT DOCUMENTS 4,524,817 A * 6/1985 Brugger et al. ..... 164/290

6,443,212 B1 * 9/2002 Choudhury et al. ..... 164/118

* cited by examiner

*Primary Examiner*—Kuang Y. Lin
(74) *Attorney, Agent, or Firm*—Fulbright & Jaworski L.L.P.

(57) ABSTRACT

To produce precision castings from a melt, use is made of a metallic casting wheel (1) which has an annular distribution channel (4) and a plurality of interchangeable casting moulds (6), each having at least one filling opening **(6*a*). The melt quantity per casting operation is chosen here such that the casting moulds (6) and the distribution channel (4) are filled with the melt upon the rotation of the casting wheel (1) about its axis (A—A), in such a way that after the solidification of the melt the precision castings are held together by a ring of the casting material which is formed in the distribution channel (4), the so-called circulating material for new casting processes, and are removed from the casting wheel (1) together with the casting moulds (6), whereupon the precision castings are separated from the ring. In order to be able to produce precision castings with complicated three-dimensional shapes, in particular with undercuts, by this means as well, the casting moulds (6), which can be used only once and are destructible for the purpose of demoulding, are selected from a ceramic material and are attached in a positive-locking and interchangeable manner to the casting wheel (1)** and so as to protrude therefrom. As a result, the circulating material can be fed uncontaminated to a recycling process.

14 Claims, 5 Drawing Sheets

PROCESS AND APPARATUS FOR PRODUCING PRECISION CASTINGS

FIELD OF THE INVENTION

The invention relates to a process for producing precision castings from a melt by means of a metallic casting wheel having an annular distribution channel and having a plurality of interchangeable casting moulds, each having at least one filling opening, the melt quantity per casting operation being chosen such that the casting moulds and the distribution channel are filled with the melt upon the rotation of the casting wheel about its axis, in such a way that after the solidification of the melt the precision castings are held together by a ring of the casting material which is formed in the distribution channel and are removed from the casting wheel together with the casting moulds, whereupon the precision castings are separated from the ring and the material of the ring is fed to a recycling process.

It concerns in particular, but not exclusively, the production of precision castings composed of titanium-containing materials.

BACKGROUND AND SUMMARY OF THE INVENTION

A process, disclosed by EP 0 686 443 A1, deals primarily with the selection of particular mould materials which have an influence on the casting and solidification behaviour of melts composed of titanium-containing materials such as

| | |
|---|---|
| pure titanium, | Ti 6 Al 4 V, |
| Ti 6 Al 2 Sn 4 Zr 2 Mo, | Ti 5 Al 2.5, Sn |
| Ti 15 V 3 Al 3 Cr 3 Sn, | Ti Al 5 Fe 2.5 |
| 50 Ti 46 Al 2 Cr 2 Nb titanium aluminides. | |

The invention also embraces such casting materials, but is not restricted to them. Examples of other suitable materials are nickel-based alloys, high-temperature nickel aluminides, in particular materials which are highly reactive at their casting temperature, which also includes the above casting materials.

Possible applications are in the field of internal combustion engines, e.g. for parts which move in oscillating fashion, such as valves, connecting rods and piston pins, where the mass, noise and thermal behaviour plays a role. But possible applications are also in the field of rotating machines, such as turbine wheels, turbine blades, compressor wheels and parts thereof, that is to say all mass-produced articles, where the production costs, precision and compliance with all product parameters play a crucial role. Further interesting fields of application are biomedical prostheses, such as, for example, implants, sporting and leisure articles, tools and the like.

If such materials have simple geometries, that is to say are designed for example rotationally symmetrically, such as valves, it is possible to employ separable metallic moulds which can be reused as often as desired and which merely have to be opened, but not destroyed, to demould the castings.

In the process disclosed by EP 0 686 443 A1, a plurality of rings of castings are produced in each case in separable moulds around a central runner, and these castings are also joined between the rings by the material solidified in the runner to form a tree or cluster of castings. There is a further consideration: most of the above-described materials are hard and brittle at room temperature, and solid but still ductile at temperatures between about 200° C. and 300° C. Upon demoulding at room temperature, however, brittle fractures may occur, leading to rejects.

The known apparatus is not intended for ceramic casting moulds which can be used only once and have to be destroyed to demould complicated castings.

DE 19 84 678 B2 and the corresponding EP 0 992 305 A1 likewise disclose the production of precision castings by casting melt into separated metallic casting moulds, which are arranged in radial orientation within an axially separated metallic casting wheel. The arrangement of the casting moulds within the casting wheel results in the formation, between its radial walls, of a distribution channel which directly communicates with the mould cavities of the casting moulds. The melt quantity is chosen per casting operation such that after the solidification of the melt a ring of casting material is also present in the distribution channel, from which ring the castings protrude radially and with which ring they form a one-piece cast body. After the opening of the casting wheel and removal of the cast body, the castings are demoulded by removal of casting-mould parts, reusable as often as desired, and are separated from the ring. With this casting technology, which is applicable only to nondestructively demouldable castings, such as, for example, engine valves, the melt does not come into contact with ceramic or oxidic materials at any point, so that the material quantities which do not belong to the castings, and this includes in particular the ring, can be melted down again and recast. These quantities of expensive materials, the so-called "circulating material", amount to about 50 to 70% of the total material quantity.

In the case of the production of complicated, in particular, undercut, precision castings, which can be demoulded only with the destruction of the casting moulds, casting technology has retained the practice of using new, ceramic or oxidic casting moulds for each casting operation. For economical fabrication to be possible here, such casting moulds are connected by ceramic or oxidic casting channels, resulting in whole clusters of castings, the entire surfaces of which have come into contact with the ceramic or oxidic cluster moulds and thereby been contaminated. Although this is still tolerable for the precision castings themselves, it makes the reuse or recycling of the remaining material quantities (the circulating material) problematical, since the contaminating components accumulate therein. It was therefore decided to allow such material quantities to be reused as "circulating material" only once. This increases the cost of the production process enormously, particularly in the case of expensive casting materials, such as, for example, the materials based on titanium, in particular the very expensive titanium aluminides, described at the outset.

Owing to its high affinity for oxygen, titanium especially, given the material-dependent processing temperatures (it cannot be demoulded at room temperature owing to brittleness), has the property of absorbing oxygen and oxygen compounds from the ceramic mould materials and even reacting with these mould materials. The contact with ceramic materials causes a marked reduction in the ductility of the casting material and makes reuse of the "circulating material" or "return scrap" more difficult, it only being possible consequently to add this material again in small quantities in precision casting processes.

The object on which the invention is based therefore is to specify a process and an apparatus which enable the use, with high productivity, of ceramic casting moulds usable only once, without the circulating material being contaminated to an unacceptable level and the reuse, recycling, of this circulating material being intolerably restricted. These requirements are in a way diametrically opposed.

The stated object is achieved according to the invention for the process specified at the outset in that the casting moulds are selected from a ceramic material and are attached in a positive-locking and interchangeable manner to the casting wheel and so as to protrude therefrom.

The spatial orientation of the casting moulds and their mould cavities may be radial, oblique or tangential to the casting wheel. It is also possible for the casting moulds to have more than one, e.g. two, filling openings. Casting moulds having a filling opening at each of the two ends of the mould cavity may be used especially for casting turbine blades. The axis of rotation of the casting wheel does not have to be horizontal either, but may also be oriented at an angle to the horizontal or even vertically. In the last-mentioned case, one side of the casting wheel should then preferably be closed.

By means of the invention, the stated object is achieved in its entirety, in particular the use, with high productivity, of ceramic casting moulds usable only once is enabled, without the circulating material being contaminated to an unacceptable level and the reuse, recycling, of this circulating material being intolerably restricted. The diametrically opposed requirements are thus simultaneously achieved.

The melt comes into contact with ceramic or oxidic materials only inside the casting moulds, i.e. only once, but this is not the case of the material quantities not belonging to the castings, and this includes in particular the ring, it being possible for these material quantities to be melted down again and recast. These quantities of expensive materials, the so-called "circulating material", which amounts to about 50 to 70% of the total material quantity, can thus be reused without significant restrictions. There is no increasing contamination due to oxygen and/or oxides, nor is it necessary to limit the number of precision castings to so-called clusters. The invention enables, for example, the simultaneous production of about 50 turbocharger wheels in one process cycle.

This enables the economical production of complicated, in particular, undercut, precision castings which can be demoulded only with the destruction of the casting moulds. As a result, the cost of the production process is reduced enormously, particularly in the case of expensive casting materials, such as, for example, the materials based on titanium, in particular the very expensive titanium aluminides, described at the outset. The ductility of the casting material is preserved and enables multiple reuse of the "circulating material" or of the "return scrap", which can consequently be added again in large quantities in precision casting processes.

In further refinements of the process according to the invention, it is particularly advantageous if: the casting wheel used is one having two wheel rings which abut against each other at an annular parting line in which recesses for inserting the casting moulds are situated, if after the insertion of the casting moulds the wheel rings are moved together axially with the formation of the distribution channel, and if after the casting operation the wheel rings are moved apart axially with the release of the ring of casting material, together with the casting moulds and the precision castings.

The invention also relates to an apparatus for producing precision castings from a melt by means of a metallic casting wheel having an annular distribution channel and having a plurality of interchangeable casting moulds, each having at least one filling opening, it being possible for the casting moulds and the distribution channel to be filled with the melt upon the rotation of the casting wheel about its axis, in such a way that after the solidification of the melt the precision castings are held together by a ring of the casting material which is formed in the distribution channel and can be removed from the casting wheel together with the casting moulds.

To achieve the same object, such an apparatus is characterised according to the invention in that the casting moulds are selected from a ceramic material and are attached in a positive-locking and interchangeable manner to the casting wheel and so as to protrude therefrom.

In further refinements of the apparatus according to the invention, it is particularly advantageous if—either individually or in combination:

- the casting wheel has two wheel rings which abut against each other at an annular parting line in which recesses for inserting the casting moulds are situated, if after the insertion of the casting moulds the wheel rings can be moved together axially with the formation of the distribution channel, and if after the casting operation the wheel rings can be moved apart axially with the release of the ring of casting material, together with the casting moulds and the precision castings;
- the casting moulds each have a flanged edge which surrounds their filling openings and is insertable in a positive-locking manner, at least substantially parallel to the axis of the casting wheel, into the complementary recesses in the parting line of the casting wheel;
- the wheel rings are provided at their outsides with holding rings which engage behind the flanged edges of the casting moulds on in each case part of their periphery;
- at least one of the holding rings can be detached from the associated wheel ring and fitted with the casting moulds outside the casting wheel;
- at least one of the holding rings is subdivided into sectors;
- there are arranged in at least one of the wheel rings casting gates which connect the distribution channel to the filling openings of the casting moulds;
- the casting moulds are surrounded by an annular catching channel;
- the catching channel has an annular disc, a cylindrical body and a radially inwardly directed annular flange, and if the catching channel is fastened to one of the wheel rings;
- the respective other wheel ring has fastened to it a further annular disc which, when the casting wheel is closed, at least substantially closes an opening in the catching channel;
- the casting wheel is assigned a loading device, by means of which preheated casting moulds are insertable into the casting wheel;
- the loading device is designed to receive at least one of the holding rings; and/or if
- the loading device is designed to receive sectors of at least one of the holding rings.

The subject-matter of the invention is preferably suitable for the centrifugal casting of precision castings.

An exemplary embodiment of the subject-matter of the invention and the way in which it works are explained in more detail below with reference to FIGS. 1 to 6.

DETAILED DESCRIPTION

Figure 1:
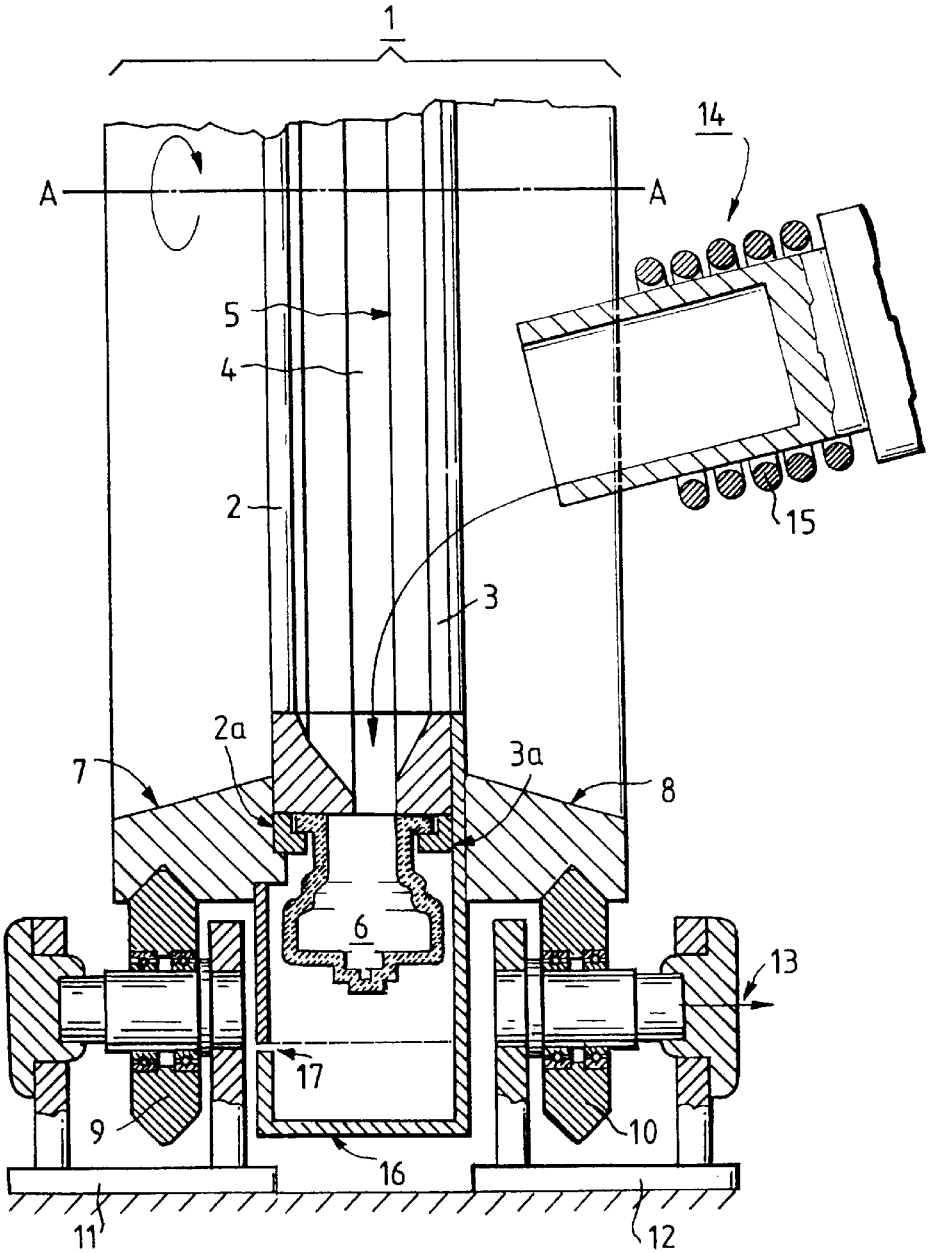
FIG. 1 shows a half axial section along the axis of a casting wheel having two wheel rings during a casting operation.
Figure 4:
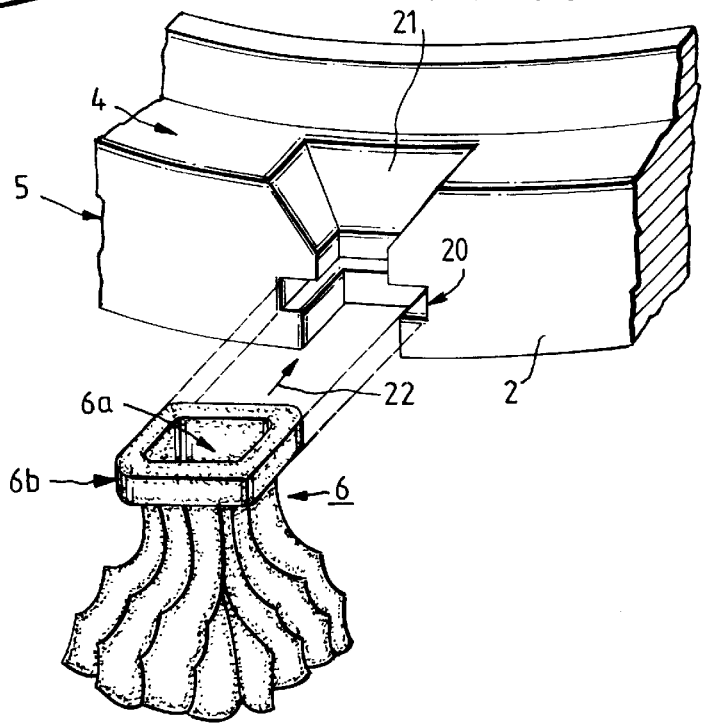
FIG. 4 shows a cutout from FIG. 3 in a perspective view with a casting mould before it is pushed into the wheel ring.

FIG. 1 illustrates a casting wheel 1 comprising two wheel rings 2 and 3 made of niobium with a common axis of rotation A—A and enclosing an annular distribution channel 4 between them. The wheel rings 2 and 3 abut leaktightly against each other at a parting line 5. Numerous casting moulds 6, the filling openings 6*a* of which are aligned with the distribution channel 4, are attached to the casting wheel 1 on the periphery. Details of the detachable fastening are shown in FIG. 4. For this purpose, the wheel rings 2 and 3 have corresponding L-shaped holding rings 2*a* and 3*a*, which consist of steel or a nickel-based alloy, and can also be constructed integrally with the wheel rings 2 and 3 from niobium, as shown in FIG. 4.

At their outsides 2*b* and 3*b*, the wheel rings 2 and 3 have coaxial guide rings 7 and 8 made of steel, which form annular rails so to speak and run in guide rollers 9 and 10 which are arranged in a manner distributed on the periphery and of which in each case only one is illustrated. The guide rollers 9 and 10, of which at least one is driven, are mounted in bearing blocks 11 and 12, of which the right-hand one is displaceable in the direction of the arrow 13 in order to bring the casting wheel 1 into the open position according to FIG. 2. The casting wheel 1 is charged, according to FIG. 1, by a tiltable melting crucible 14, which can be heated together with its contents, the casting material, by an induction coil 15. The melting crucible 14 is constructed as a metallic "cold-wall crucible" of known design, so that the melt cannot be contaminated by crucible material. Such cold-wall crucibles comprise hollow, cooled copper sectors which are arranged side by side on the periphery in the manner of a palisade, so that a "skull" of the casting material forms on the inside and prevents any contamination of the casting material. If necessary, a removable guiding device (not shown here) for the melt may also be arranged between the melting crucible 14 and the distribution channel 4.

To avoid contamination (e.g. oxidation) by gases, the entire arrangement is arranged in a chamber (not shown here) in which a vacuum or a protective atmosphere can be maintained. In order to prevent melt from escaping in the event of the rupture of one of the ceramic casting moulds or in the event of another leak, the casting wheel 1 together with all the casting moulds 6 is surrounded by an annular and coaxial catching channel 16 which is firmly connected to the casting wheel 1, but can be opened according to FIG. 2.

Figure 2:
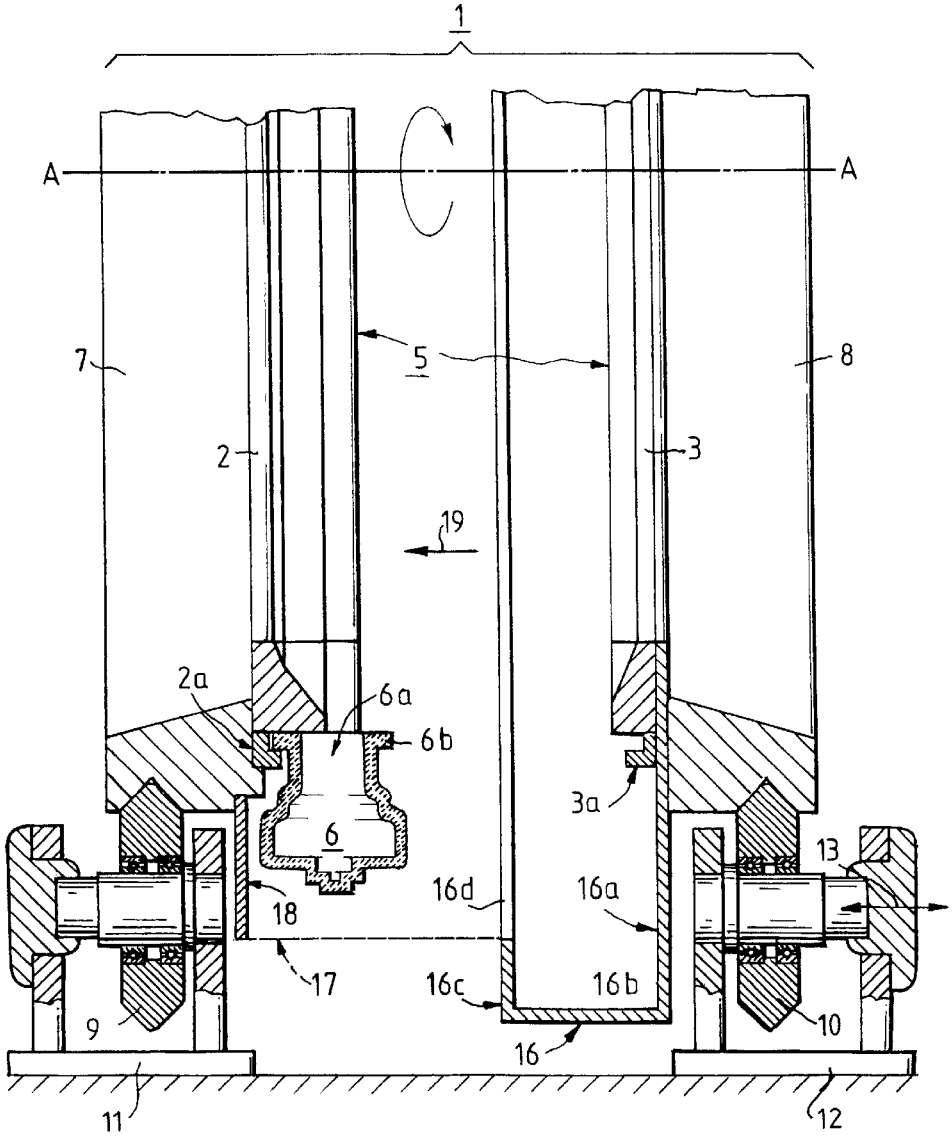
FIG. 2 shows the casting wheel according to FIG. 1 in the opened state for inserting the casting moulds and for removing the castings together with the filled casting moulds.

This state is now shown in FIG. 2: the wheel rings 2 and 3 are opened at their radial parting line 5 and are designed, in cross-section, asymmetrically relative to it, so that the casting moulds 6 can be reliably held and, according to FIG. 4, inserted in a positive-locking manner. In the closed state according to FIG. 1, the right-hand holding ring 3*a* also engages under the right-hand part of the edge 6*b* running all the way round the casting moulds 6. The catching channel 16 too is designed in two parts asymmetrically with respect to an axial parting line 17 running all the way round and comprises, on the side of the right-hand wheel ring 3, an annular disc 16*a*, a cylindrical body 16*b* and an annular flange 16*c* directed radially inwards from the latter. Fastened to the left-hand wheel ring 2 is a further annular disc 18, which engages in an opening 16*d* of the annular flange 16*c* during the casting operation according to FIG. 1.

Figure 3:
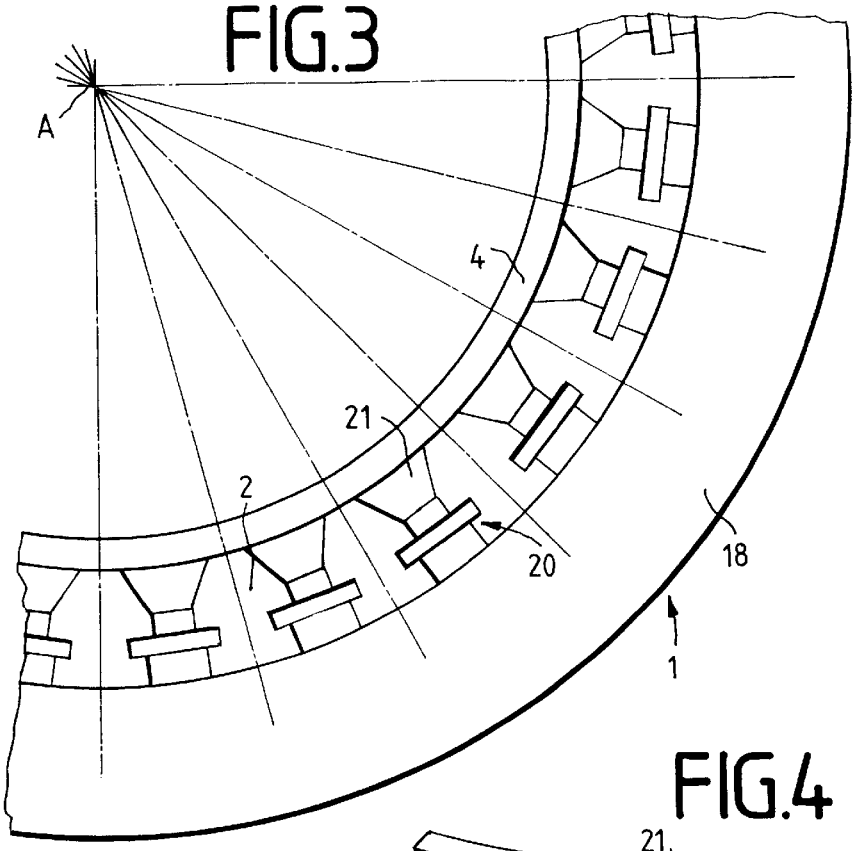
FIG. 3 shows a sector-shaped cutout from the left-hand wheel ring viewed in the axial direction according to the arrow in FIG. 2, but without casting moulds.

FIG. 3 shows a sector-shaped cutout from the left-hand wheel ring 2 viewed in the axial direction according to the arrow 19 in FIG. 2, but without casting moulds 6. In conjunction with FIG. 4, the following emerges: the casting moulds 6 have a radial filling opening 6*a* and an edge 6*b* surrounding the latter. For this edge, there are arranged in the wheel part 2 complementary recesses 20 which are widened radially inwards to form in each case a pyramidal casting gate 21 which merges directly into the distribution channel 4. The casting moulds 6 can be pushed into these recesses 2 in the direction of the arrow 22 (FIG. 4); in the pushed-in position and after the closure of the casting wheel 1 (FIG. 1), they are firmly and leaktightly held by the holding ring 3*a* on the right-hand wheel ring 3.

Figure 5:
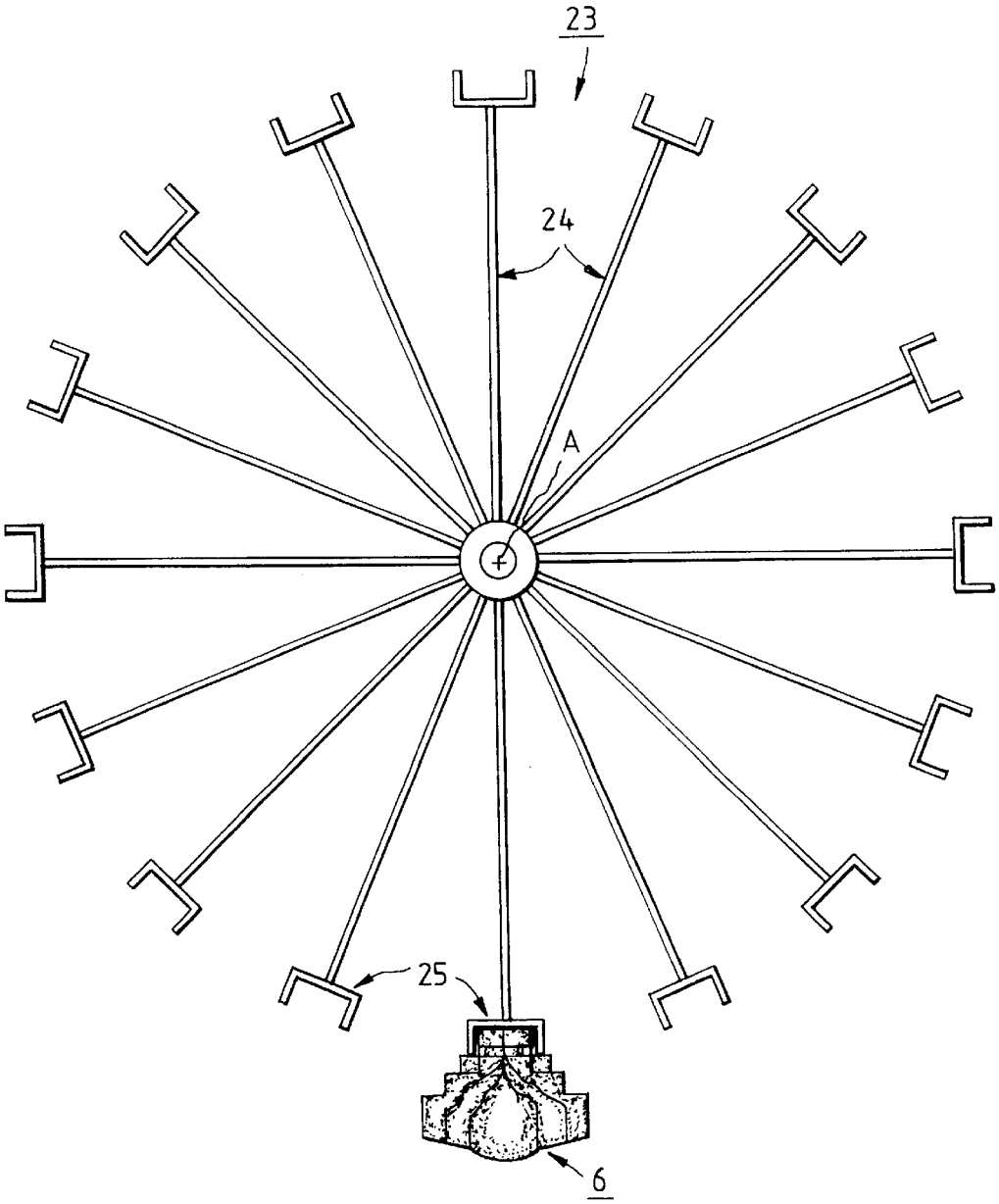
FIG. 5 shows a basic illustration of a first exemplary embodiment of an automatic loading device for casting moulds viewed in the axial direction.

FIG. 5 shows a basic illustration of an automatic loading device 23 for casting moulds 6 viewed in the axial direction. Arranged on radial arms 24 are grippers 25 which hold a corresponding number of preheated ceramic casting moulds 6, transport these successively to a position in front of the recesses 20 and push them into the latter. Only one of the casting moulds 6 is illustrated here.

Figure 6:
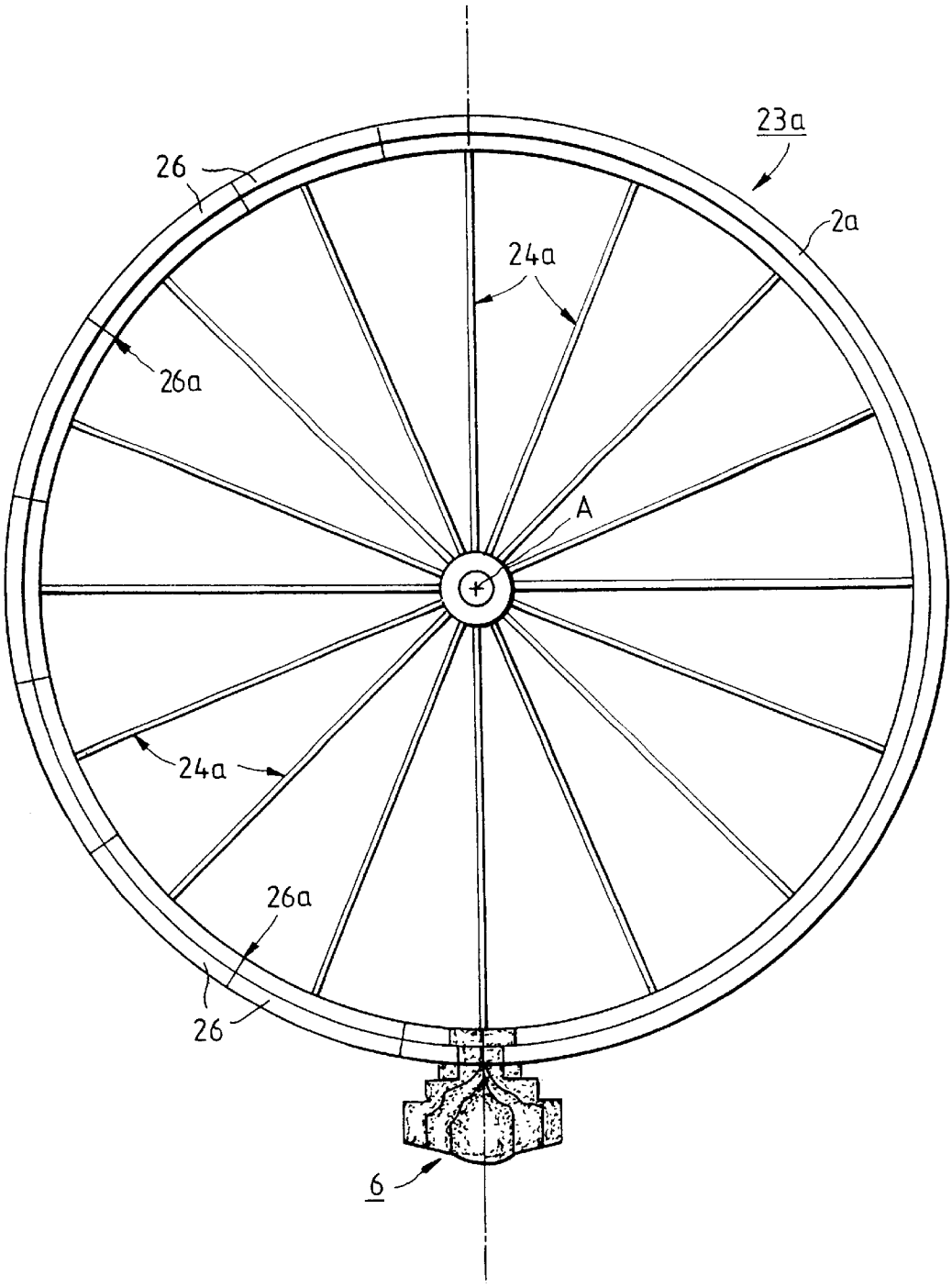
FIG. 6 shows two further exemplary embodiments of an automatic loading device for casting moulds viewed in the axial direction.

FIG. 6 shows, on the right, a basic illustration of an automatic loading device 23*a* for casting moulds 6 viewed in the axial direction. Radial arms 24*a* serve for the mounting of a holding ring 2*a*, which in reality is circumferentially closed. In the left-hand half of FIG. 6, the holding ring is subdivided into sectors 26, between which parting lines 26*a* are situated. It is understood that for both cases there are arranged at the ends of the arms 24*a* corresponding gripping devices (not shown). In these cases too, a corresponding number of preheated ceramic casting moulds 6 are held for joint insertion by the holding ring 2*a* or the sectors 26 into the casting wheel 1. Here too, only one of the casting moulds 6 is illustrated.

Heating devices, by which the casting wheel 1 and the casting moulds 6 can be heated to casting temperature, are not illustrated, for the sake of simplicity. After the solidification of the melt, the castings situated in the casting moulds 6 are joined to one another in the form of a star by the annular material situated in the casting gates 21 and the distribution channel 4. This structure can be easily removed from the casting wheel, if necessary by automatic means. After the severing of the casting moulds, the castings can be demoulded, and the material quantities in the casting gates 21 and also the material in the distribution channel 4 can be repeatedly melted down again and used for new casting operations, since it has not come into contact with the ceramic material of the casting moulds 6. The degree of utilisation of the casting material is thereby considerably improved.

It is claimed:

1. A process for producing precision castings in an apparatus comprising a metallic casting wheel having an annular distribution channel and a plurality of interchangeable ceramic casting molds which are attached in a positive-locking and interchangeable manner to said casting wheel so as to protrude therefrom, wherein each of said molds has at least one filling opening, said method comprising the steps of selecting the melt quantity per casting operation such that the casting moulds and the distribution channel are filled with the melt upon the rotation of the casting wheel about its axis (A—A), in such a way that alter the solidification of the melt the precision castings are held together by a ring of the casting material which is formed in the distribution channel, and removing the ring with the casting molds from the casting wheel, separating the precision castings from the ring and recycling the material from the ring is fed to a recycling process; wherein said casting wheel has two wheel rings which abut against each other at an annular parting line in which recesses for inserting the casting moulds are situated, wherein after the casting molds are inserted the wheel rings are moved together axially with the formation of the distribution channel, and after the casting operation the wheel rings are moved apart axially with the release of the ring of casting material, together with the casting molds and the precision castings.

2. An apparatus for producing precision castings from a melt by means of a metallic casting wheel having an annular distribution channel and having a plurality of interchangeable casting molds, each having at least one filling opening, it being possible for the casting molds and the distribution channel to be filled with the melt upon the rotation of the casting wheel about its axis (A—A), in such a way that after the solidification of the melt the precision castings are held together by a ring of the casting material which is formed in the distribution channel and can be removed from the casting wheel together with the casting molds, wherein the casting molds are selected from a ceramic material and are attached in a positive-locking and interchangeable manner to the casting wheel and so as to protrude therefrom; wherein the casting wheel has two wheel rings which abut against each other at an annular parting line in which recesses for inserting the casting molds are situated, in that after the insertion of the casting molds the wheel rings can be moved together axially with the formation of the distribution channel, and in that after the casting operation the wheel rings can be moved apart axially with the release of the ring of casting material, together with the casting molds and the precision castings.

3. An apparatus according to claim 2, wherein the casting molds each have a flanged edge which surrounds their filling openings and is insertable in a positive-locking manner, at least substantially parallel to the axis (A—A) of the casting wheel, into the complementary recesses in the parting line of the casting wheel.

4. An apparatus according to claim 3, wherein the outsides of said wheel rings are provided with holding rings which engage behind the flanged edges of the casting molds on in each cast part of their periphery.

5. An apparatus according to claim 4, wherein said at least one of the holding rings can be detached from the associated wheel ring and fitted with the casting molds outside the casting wheel.

6. An apparatus according to claim 5, wherein at least one of holding rings is subdivided into sectors.

7. An apparatus according to claim 2, wherein there are arranged in at least one of the wheel rings casting gates which connect the distribution channel to the filling openings of the casting molds.

8. An apparatus according to claim 4, wherein the casting wheel is assigned a loading device, by means of which preheated casting are insertable into the casting wheel.

9. An apparatus according to claim 8, wherein the loading device is designed to receive at least one holding ring.

10. An apparatus according to claim 5, wherein the loading device is designed to receive at least one of said holding rings.

11. An apparatus according to claim 8, wherein the loading device is designed to receive at least one of the holding rings.

12. An apparatus according to claim 6, wherein the loading device is designed to receive sectors of at least one of the holding rings.

13. An apparatus for producing precision castings from a melt by means of a metallic casting wheel having an annular distribution channel and having a plurality of interchangeable casting molds, each having at least one filling opening, it being possible for the casting molds and the distribution channel to be filled with the melt upon the rotation of the casting wheel about its axis (A—A), in such a way that after the solidification of the melt the precision castings are held together by a ring of the casting material which is formed in the distribution channel and can be removed from the casting wheel together with the casting molds, wherein, the casting molds are selected from a ceramic material and are attached in a positive-locking and interchangeable manner to the casting wheel and so as to protrude therefrom wherein the catching channel has an annular disc, a cylindrical body and a radially inwardly directed annular flange, and in that the catching channel is fastened to one of the wheel rings and the casting molds are surrounded by an annular catching channel.

14. An apparatus according to claim 13, wherein the respective other wheel ring has fastened to it a further annular disc which, when the casting wheel is closed, at least substantially closes an opening in the catching channel.

* * * * *